United States Patent [19]

Fatovic et al.

[11] Patent Number: 4,528,426

[45] Date of Patent: Jul. 9, 1985

[54] DIRECTIONAL MICROPHONE ASSEMBLY

[75] Inventors: Peter Fatovic, Ottawa; Conrad D. Lafrance, Aylmer, both of Canada

[73] Assignee: Northern Telecom Limited, Montreal, Canada

[21] Appl. No.: 555,139

[22] Filed: Nov. 25, 1983

[51] Int. Cl.[3] ..... H04R 1/28

[52] U.S. Cl. ..... 179/121 D; 179/179; 381/88

[58] Field of Search ..... 179/121 D, 178, 179, 179/180; 181/151, 196, 178, 199; 381/87, 88

[56] References Cited

U.S. PATENT DOCUMENTS

| | | | |
|---|---|---|---|
| 3,536,862 | 10/1970 | Weingartner | 179/121 D |
| 3,560,668 | 2/1971 | Warning | 179/115.5 R |
| 4,127,751 | 11/1978 | Kinoshita | 179/180 |
| 4,151,378 | 4/1979 | Watson | 179/111 R |
| 4,151,777 | 5/1979 | Sugiyama et al. | 179/121 D |
| 4,168,762 | 9/1979 | Griffin, Jr. | 181/148 |
| 4,174,469 | 11/1979 | Kusuyama | 179/121 D |
| 4,340,787 | 7/1982 | Görike | 179/121 D |

FOREIGN PATENT DOCUMENTS

| | | | |
|---|---|---|---|
| 2418060 | 10/1975 | Fed. Rep. of Germany | 179/178 |
| 53-92119 | 8/1978 | Japan | 179/121 D |

OTHER PUBLICATIONS

"New Audio Test Report-Electro-Voice Unidirectional Mike", Electronics World, p. 114.

"A New Cardioid Microphone", Tele Tech and Electronic Industries, Oct. 1955, pp. 70-72.

*Primary Examiner*—Gene Z. Rubinson

*Assistant Examiner*—Danita R. Byrd

*Attorney, Agent, or Firm*—John E. Mowle

[57] ABSTRACT

A directional microphone assembly in which an electroacoustic transducer housed in a capsule, having a directional response characteristic, is mounted in the assembly housing and surrounded by an acoustically transparent foam covering. As a result acoustic waves reflected off surfaces of the housing are dispersed so as to minimize the effect of the surfaces on the directional response characteristic.

4 Claims, 3 Drawing Figures

DIRECTIONAL MICROPHONE ASSEMBLY

This invention relates to a directional microphone assembly and more particularly to a microphone unit which is particularly suitable for mounting adjacent an acoustically reflecting surface such as the shell of a handsfree telephone apparatus.

BACKGROUND OF THE INVENTION

Directional microphones are commonly utilized in handsfree telephone apparatus to pick up acoustical signals. The microphone units often in the form of a small cylindrical capsule, have a cardioid response characteristic in a free-field environment. To achieve this, the capsule will have a forward facing opening in the direction of maximum response and a plurality of sideward facing openings around the circumference of the unit which coact with an electroacoustic transducer therein to provide this cardioid response.

When the microphone capsule is mounted in the handsfree apparatus the cardioid response characteristic is distorted due to the reflecting surfaces of the apparatus. In addition, mechanical vibrations caused by a speaker that is located in the same apparatus, must be minimized so as to reduce feedback and/or switching between the receiving and transmitting channels of the handsfree telephone apparatus.

It is known to utilize acoustically transparent foam around a microphone to minimize howling when it is operated in a windy environment.

STATEMENT OF THE INVENTION

It has been found that this acoustically transparent foam can be used to minimize the effect of the reflecting surfaces of the housing surrounding the microphone so as to substantially retain the desired cardioid or other directional response characteristics.

Thus, in accordance with the present invention there is provided a microphone assembly comprising an electroacoustic transducer, housed in a capsule having a forward facing opening and a plurality of sideward facing openings spaced around the perimeter of the capsule. The openings coact with the electroacoustic transducer to provide a preselected free-field directional response characteristic such as a cardioid response. The capsule is surrounded and supported on at least its sides by an acoustically transparent foam covering which overlays the openings, and which disperses acoustic waves passing therethrough. The covering containing the capsule is mounted in a housing contiguous to an acoustically reflecting surface so that at least some of the sideward facing openings receive acoustic waves reflected from the reflecting surface. As a result the foam covering disperses the acoustic waves reflected from the surface so as to minimize the effect of the surface on the free-field directional response characteristic.

In a particular embodiment, the capsule is cylindrical in shape, the forward facing opening is in one end of the cylindrical capsule and the sideward facing openings are around its circumference.

In another embodiment the foam covering is located in an exterior corner of the housing against an arcuate shaped acoustically reflecting surface so that at least some of the sideward facing openings are facing the surface. Additionally this assembly includes an open frame which together with the reflecting surface surrounds and supports the acoustically transparent foam covering containing the capsule.

BRIEF DESCRIPTION OF THE DRAWINGS

An example embodiment of the invention will now be described with reference to the accompanying drawings in which.

DESCRIPTION OF THE PREFERRED EMBODIMENT

Figure 1:
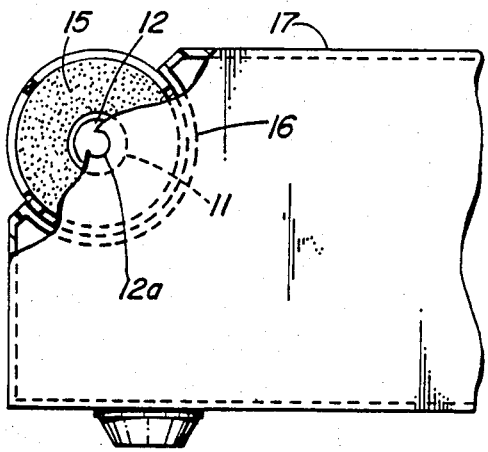
FIG. 1 is a front elevational view partly in cross-section, of a microphone assembly in accordance with the present invention.
Figure 2:
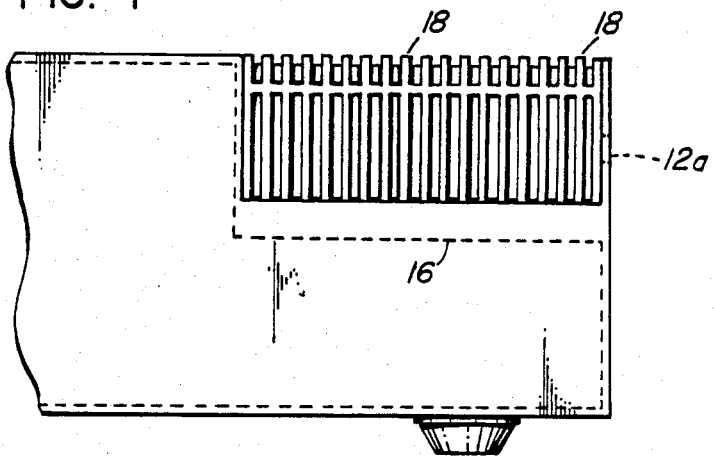
FIGS. 2 and 3 are side elevational view, the latter partly in cross-section, of the microphone assembly shown in FIG. 1.
Figure 3:
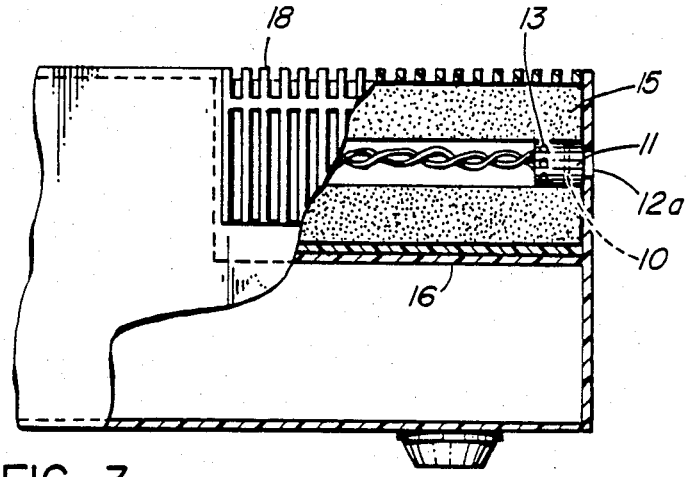

Referring to FIGS. 1 to 3, the microphone assembly comprises an electroacoustic transducer 10 housed in a cylindrical capsule 11 having a forward facing opening 12 and a plurality of sideward facing openings 13 equally spaced around the circumference of the capsule. The capsule is surrounded and supported around its circumference by an acoustically transparent foam covering 15 which overlays the openings 13. The covering 15 containing the capsule 11 is mounted against an acoustically reflecting surface 16 located in an exterior corner of a housing 17. The outer corner of the housing 17 is an open frame 18 which is substantially transparent to acoustical signals and has an opening 12A in line with the opening 12 in the capsule 11. Both the reflecting surface 16 and the frame 18 serve to surround and support the covering 15 containing the capsule 11.

The electroacoustic transducer 10 housed in the capsule 11 has a cardioid free-field directional response characteristic. This response characteristic would be severely distorted if the microphone capsule 11 were freely supported adjacent the acoustically reflecting surface 16. However, by mounting the housing 11 in the acoustically transparent foam 15, sound waves passing through the foam and reflected off the surface 16 into the circumferential holes 13, are heavily dispersed so that the effect of the surface 16 on the cardioid response, is substantially reduced. As a result, any detrimental effect upon the cardioid response characteristic is minimized.

In addition, suspending the microphone capsule 11 in the acoustically transparent foam minimizes mechanical vibrations, such as may be generated by a speaker (not shown) contained in the same housing 17, from being picked up by the electroacoustic transducer 10.

A similar structure can be used for mounting the microphone capsule 1 in the body of a telephone handset (not shown). Here, the influence of the reflecting surfaces of the handset are minimized due to the dispersion of sound waves passing through the acoustically transparent foam which surrounds the capsule. In addition, both front and back openings may be provided in the handset to transmit sound waves through the foam to the microphone capsule. In each embodiment the electroacoustic transducer 10 is connected by fine conductors to a telephone network or amplifier circuit (not shown) in a well known manner.

What is claimed is:

1. A microphone assembly comprising:

an electroacoustic transducer, housed in a capsule having a forward facing opening and a plurality of sideward facing openings spaced around the perimeter of the capsule, said openings coacting with the electroacoustic transducer to provide a preselected free-field directional response characteristic;

the capsule being surrounded and supported on at least the perimeter by an acoustically transparent foam covering which overlays the openings, and which disperses acoustic waves passing therethrough;

the covering containing the capsule being mounted in a housing contiguous to an acoustically reflecting surface of the housing so that some of the sideward facing openings receive acoustic waves reflected from said reflecting surface, whereby the foam covering disperses the acoustic waves reflected from the surface so as to minimize the effect of the surface on the free-field directional response characteristic.

2. A microphone assembly as defined in claim 1 in which said capsule is cylindrical in shape, the forward facing opening is in one end and the sideward facing openings are around the cylindrical surface of the capsule.

3. A microphone assembly as defined in claim 2 in which the foam covering is supported in an exterior corner of the housing against an arcuate shaped acoustically reflecting surface so that at least some of the sideward facing openings are facing said surface; and which additionally includes an open frame which together with the reflecting surface surrounds and supports the acoustically transparent foam covering containing the capsule.

4. A microphone assembly as defined in claim 1 in which the preselected free-field directional response characteristic is a cardioid pattern in the direction of the forward facing opening.

* * * * *